US008760317B2

(12) United States Patent
Paul et al.

(10) Patent No.: US 8,760,317 B2
(45) Date of Patent: Jun. 24, 2014

(54) HIGH OCCUPANCY VEHICLE LANE ENFORCEMENT SYSTEM USING AN INFORMATION SYSTEM FOR REDUCED FALSE POSITIVES

(75) Inventors: Peter Paul, Webster, NY (US); Mark Cantelli, Germantown, MD (US); Beilei Xu, Penfield, NY (US); Abu Islam, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 332 days.

(21) Appl. No.: 13/284,286

(22) Filed: Oct. 28, 2011

(65) Prior Publication Data

US 2013/0106622 A1 May 2, 2013

(51) Int. Cl.
*G08G 1/01* (2006.01)

(52) U.S. Cl.
USPC ..... 340/933; 340/937; 705/13

(58) Field of Classification Search
USPC ..... 340/933
See application file for complete search history.

(56) References Cited

U.S. PATENT DOCUMENTS

| | | | | |
|---|---|---|---|---|
| 8,065,181 | B2 * | 11/2011 | McNew et al. | 705/13 |
| 2006/0044161 | A1 * | 3/2006 | Feldman et al. | 340/933 |
| 2008/0175438 | A1 * | 7/2008 | Alves | 382/105 |
| 2009/0309974 | A1 * | 12/2009 | Agrawal et al. | 348/159 |
| 2011/0137773 | A1 * | 6/2011 | Davis et al. | 705/34 |

* cited by examiner

*Primary Examiner* — Kerri McNally
(74) *Attorney, Agent, or Firm* — MH2 Technology Law Group LLP

(57) ABSTRACT

An upstream vehicle detection system captures images of a vehicle as it travels through a high occupancy vehicle (HOV) lane or high occupancy vehicle tolling (HOT) station and generates an hypothesis as to whether the vehicle is complying with HOV or HOT rules based on image analysis. A database of historical information about various vehicles' compliance with HOV or HOT rules is consulted to determine whether the vehicle has previously been identified as a potential violator and pulled over by law enforcement as a result. If the vehicle was previously pulled over by law enforcement and determined to be complying with HOV or HOT rules (a false positive), then the violation hypothesis may be weighted in favor of not pulling the vehicle over.

22 Claims, 11 Drawing Sheets

410

VEHICLE

| VEHICLE_ID | LICENSE_PLATE_NO | STATE | MAKE | MODEL | COLOR | VEHICLE_TYPE_ID |
|---|---|---|---|---|---|---|
| 1234 | NJN 0213 | MI | CHEVROLET | CORSICA | RED | 2 |
| 1235 | RDN 0702 | PA | TOYOTA | CAMRY | BROWN | 2 |
| 1236 | TJN 0822 | TN | HONDA | ODYSSEY | SILVER | 2 |
| ⋮ | ⋮ | ⋮ | ⋮ | ⋮ | ⋮ | ⋮ |
| 9999 | GJN 0624 | VA | ACURA | MDX | BLACK | 2 |

FIG. 4A

420

VEHICLE_TYPE

| VEHICLE_TYPE_ID | AUTHORIZED? |
|---|---|
| 1 | YES |
| 2 | NO |

FIG. 4B

| VEHICLE_ID | DATE_AND_TIME | LOCATION_ID | CONFIDENCE_LEVEL | VIOLATION? | OFFICIAL_ACTION_ID |
|---|---|---|---|---|---|
| 1236 | 2008-05-11 | 201 | 70 | YES | 2 |
| ... | ... | ... | ... | ... | ... |
| 1234 | 2011-01-22 | 287 | 35 | NO | 3 |
| ... | ... | ... | ... | ... | ... |
| 1236 | 2011-03-27 | 201 | 55 | YES | 1 |
| ... | ... | ... | ... | ... | ... |
| 9999 | 2011-04-15 | 331 | 90 | NO | 3 |
| ... | ... | ... | ... | ... | ... |
| 1234 | 2011-05-05 | 670 | 75 | YES | 1 |
| ... | ... | ... | ... | ... | ... |
| 1235 | 2011-06-13 | 005 | 60 | YES | 4 |

440

OFFICIAL_ACTION

| OFFICIAL_ACTION_ID | ACTION_TAKEN | ADJUSTMENT_POINTS |
|---|---|---|
| 1 | TICKET | 20 |
| 2 | WARNING | 30 |
| 3 | DISMISSED | -20 |
| 4 | EXCUSED | 0 |

FIG. 4D

450

CONFIDENCE_THRESHOLD

| TIME | THRESHOLD |
|---|---|
| 0600-0800 | 65 |
| 0800-0900 | 80 |
| 0900-1000 | 75 |
| 1000-1100 | 55 |

FIG. 4E

HIGH OCCUPANCY VEHICLE LANE ENFORCEMENT SYSTEM USING AN INFORMATION SYSTEM FOR REDUCED FALSE POSITIVES

TECHNICAL FIELD

The present disclosure relates generally to methods and systems for enforcing compliance with high occupancy vehicle lane and/or tolling traffic rules using an information system that utilizes historical information to reduce the likelihood of law enforcement erroneously pulling over non-offenders and increasing the likelihood of identifying actual offenders.

BACKGROUND

In high occupancy vehicle (HOV) lane and high occupancy tolling (HOT) systems, vehicle operators are incentivized to "car pool" by allowing high occupancy vehicles to use certain lanes that tend to be less congested or to pay reduced toll fees. HOV and HOT systems, thus, promise better highway utilization and reduced traffic congestion when HOV and HOT rules are observed by vehicle operators. In practice, however, the enforcement of HOV and HOT systems is difficult, and violation rates of up to 65% have been reported. Current enforcement methods include relying on law enforcement to visually observe vehicles, visually determine potential violators, and then pull over such vehicles to determine actual violation status and, if appropriate, take official action, such as issuing a ticket. This approach can be dangerous, especially in the context of fast highway conditions and tight spaces. It is also frequently ineffective, and enforcement rates of only 10% are typical.

In addition, law enforcement may pull vehicles over that were erroneously determined to be violating one of more HOV rules as the result of difficult to observe passengers, such as children riding in rear seats, leading to "false positives." Such false positives are not only great nuisances to HOV-abiding vehicle operators, but they also effectively waste the limited resources of law enforcement, which may be able to pull over only a subset of candidate violators, thus allowing other, actual violators to avoid detection during the time that law enforcement is reacting to false positives. This conventional approach also suffers from the drawback that, by relying on human operators (i.e., law enforcement, which may comprise a rotating array of different police officers, each with different memory and abilities), it cannot take into account historical patterns with respect to individual vehicles' compliance with or violation of HOV or HOT rules, which may provide a guide as to whether a given vehicle is presently violating HOV or HOT rules.

Accordingly, there is a need for methods and systems for utilizing historical information about individual vehicles' compliance with or violation of HOV or HOT rules, including previous false positives or actual violations, to improve the accuracy of hypotheses as to whether the same vehicles may be presently violating one or more HOV or HOT rules.

SUMMARY OF THE INVENTION

The present invention comprises methods and systems for utilizing historical information about individual vehicles' compliance with or violation of HOV or HOT rules, including previous false positives or actual violations, to improve the accuracy of hypotheses as to whether the same vehicles may be presently violating one or more HOV or HOT rules. In some embodiments, an upstream vehicle detection system captures images of a vehicle as it travels through an HOV lane or HOT station and generates an hypothesis as to whether the vehicle is complying with HOV or HOT rules based on image analysis. A database of historical information about various vehicles' compliance with HOV or HOT rules is consulted to determine whether the vehicle has previously been identified as a potential violator and pulled over by law enforcement as a result. If the vehicle was previously pulled over by law enforcement and determined to be actually violating HOV or HOT rules, then the violation hypothesis may be weighted in favor of pulling the vehicle over more heavily than if the vehicle had no previous HOV or HOT history. If, on the other hand, the vehicle had been previously determined to be complying with HOV or HOT rules once pulled over by law enforcement (a false positive), then the violation hypothesis may be weighted in favor of not pulling the vehicle over.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments of the invention and together with the description, serve to explain the principles of the invention. In the drawings:

FIG. 4*a* depicts an exemplary instance of a "Vehicle" table in the historical database, consistent with certain disclosed embodiments;

FIG. 4*b* depicts an exemplary instance of a "Vehicle_Type" table in the historical database, consistent with certain disclosed embodiments;

FIG. 4*d* depicts an exemplary instance of an "Official_Action" table in the historical database, consistent with certain disclosed embodiments;

FIG. 4*e* depicts an exemplary instance of a "Confidence_Threshold" table, consistent with certain disclosed embodiments;

DETAILED DESCRIPTION

Figure 1:
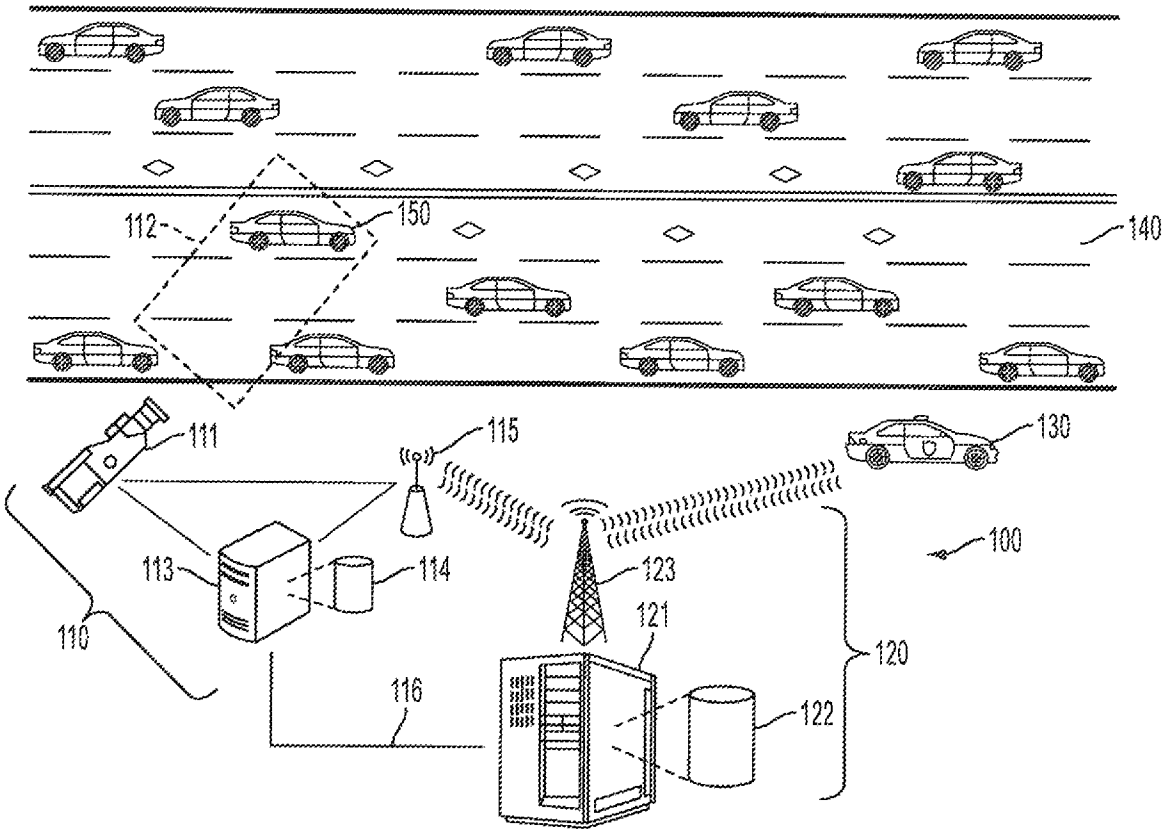
FIG. 1 is a diagram illustrating a system for automatically detecting potential high-occupancy vehicle lane or tolling violators and providing violation detection information to law enforcement, consistent with certain disclosed embodiments.

The following detailed description refers to the accompanying drawings. Wherever possible, the same reference numbers are used in the drawings and the following description to refer to the same or similar parts. While several exemplary embodiments and features of the invention are described herein, modifications, adaptations, and other implementations are possible, without departing from the spirit and scope of the invention. Accordingly, the following detailed description does not limit the invention. Instead, the proper scope of the invention is defined by the appended claims.

FIG. 1 is a diagram illustrating a system for automatically detecting potential high-occupancy vehicle lane or tolling violators and providing violation detection information to law enforcement, consistent with certain disclosed embodiments. As depicted in FIG. 1, a high-occupancy vehicle ("HOV") enforcement system 100 may comprise a vehicle detection system 110, a violation analysis system 120, and a law enforcement system 130.

Vehicle detection system 110 may comprise one or more devices, such as digital camera 111, that are configured to capture image data related to one or more vehicles 150 that are detected traveling in an HOV lane 140 of a road within a certain image capture zone 112. Vehicle detection system 110 may also comprise one or more devices, such as computer 113, configured to analyze image data captured by digital camera 111, to determine, inter alia, vehicle identification information and vehicle passenger configuration information. Computer 113 may also contain or be coupled to one or more local data stores, such as database 114, for storing image information or vehicle information ascertained through image analysis, or for storing or retrieving historical information in order to make automated decisions regarding potential violators, as will be further described below. Vehicle detection system 110 may also comprise one or more wireless transmission and/or reception devices, such as wireless radio transceiver 115, for communicating information with violation analysis system 120 and/or law enforcement system 130. Additionally or alternatively, vehicle detection system 110 may communicate such information using one or more wired links, such as wired network connection 116, which may comprise, for example, a serial connection, an Ethernet connection, or any other suitable connection for transmitting and receiving information. Although not depicted, vehicle detection system 110 may communicate with violation analysis system 120, law enforcement system 130, or any other devices using a general purpose network connection such as the Internet.

Violation analysis system 120 may comprise one or more computing devices, such as server 121, for receiving vehicle detection information and making automated decisions regarding potential violators using historical information. Server 121 may contain or be coupled with one or more data stores, such as database 122, that store historical information related to previously detected compliance with or violation of HOV rules by one or more vehicles. Violation analysis system 120 may also comprise one or more wireless transmission and/or reception devices, such as wireless radio transceiver 123, for communicating information with vehicle detection system 110 and/or law enforcement system 130.

Law enforcement system 130 may comprise componentry (not depicted) resident in a law enforcement vehicle, such as a police car, for communicating with vehicle detection system 110 and/or violation analysis system 120, either of which may provide information to enable one or more law enforcement officers to make decisions as to whether to stop or "pull over" vehicles traveling in the HOV lane 140 that have been identified as potential or candidate violators of one or more HOV rules. Such componentry may also provide an interface for officers to enter information about vehicles, such as vehicles that have been manually observed as a result of actually pulling over vehicles and manually inspecting their characteristics. Those skilled in the art will appreciate that the system depicted in FIG. 1 is exemplary only, and that various other hardware, software, and logistical and structural configurations are possible.

Figure 2:
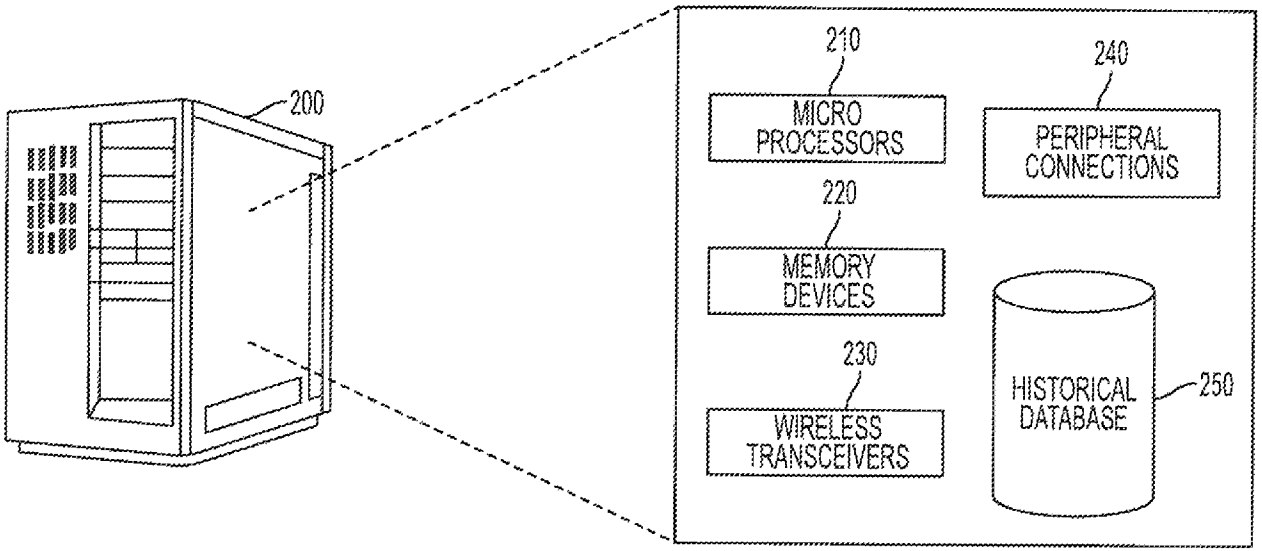
FIG. 2 is a diagram depicting an exemplary hardware and software configuration for a vehicle detection system, a violation analysis system, and/or a law enforcement information system, consistent with certain disclosed embodiments.

FIG. 2 is a diagram depicting an exemplary hardware and software configuration for a vehicle detection system, a violation analysis system, and/or a law enforcement information system, consistent with certain disclosed embodiments. As depicted in FIG. 2, each of vehicle detection system 110, violation analysis system 120, and/or a law enforcement system 130 may include one or more computing devices 200 capable of operating on data, such as data representing historical or real-time information about vehicles' compliance with HOV rules. Device 200 may comprise, for example, one or more microprocessors 210 of varying core configurations and clock frequencies; one or more memory devices or computer-readable media 220 of varying physical dimensions and storage capacities, such as flash drives, hard drives, random access memory, etc., for storing data, such as images, files, and program instructions for execution by one or more microprocessors 210; one or more wireless transceivers 230 for communicating over wireless protocols such as wireless Ethernet, code divisional multiple access (CDMA), or other wireless media; one or more peripheral connections 240, such as universal serial bus (USB), video, audio, keyboard, mouse, or other connections enabling persons or other devices to interface with device 200; and one or more databases 250, such as a relational or hierarchical database, or any other type of data store capable of storing, indexing, searching, or otherwise manipulating data. In some embodiments, database 250 may represent an historical database for storing information about vehicles, such as information about vehicles' previous compliance with or violation of HOV rules.

Figure 3:
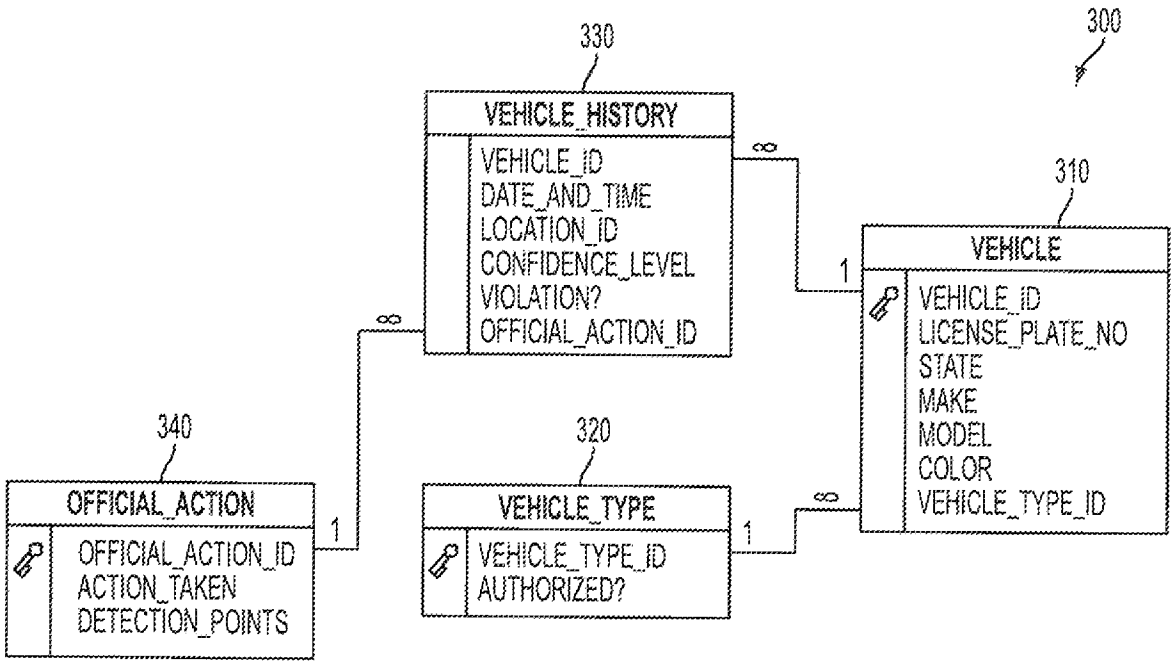
FIG. 3 is a diagram illustrating an exemplary schema for a historical database, consistent with certain disclosed embodiments.

FIG. 3 is a diagram illustrating an exemplary schema for an historical database, consistent with certain disclosed embodiments. As depicted in FIG. 3, an historical database 250, which may be located in any of vehicle detection system 110, violation analysis system 120, law enforcement system 130, or any combination of separate databases, may be organized using a relational database schema or structure 300. Database schema 300 may comprise table definitions for various tables, such as "Vehicle" table 310, "Vehicle_Type" table 320, "Vehicle_History" table 330, and "Official_Action" table 340. Database tables 310-340 may be linked in database schema 300 using traditional relational database linking mechanisms such as primary keys, one-to-one, one-to-many, and many-to-many relationships. Database tables 310-340 may further comprise various indexes for fast lookup operations. Those skilled in the art will appreciate that database schema 300 is exemplary only, and that other data and database table arrangements may be used for historical database 250, including the use of additional tables not depicted in database schema 300.

Figure 4C:
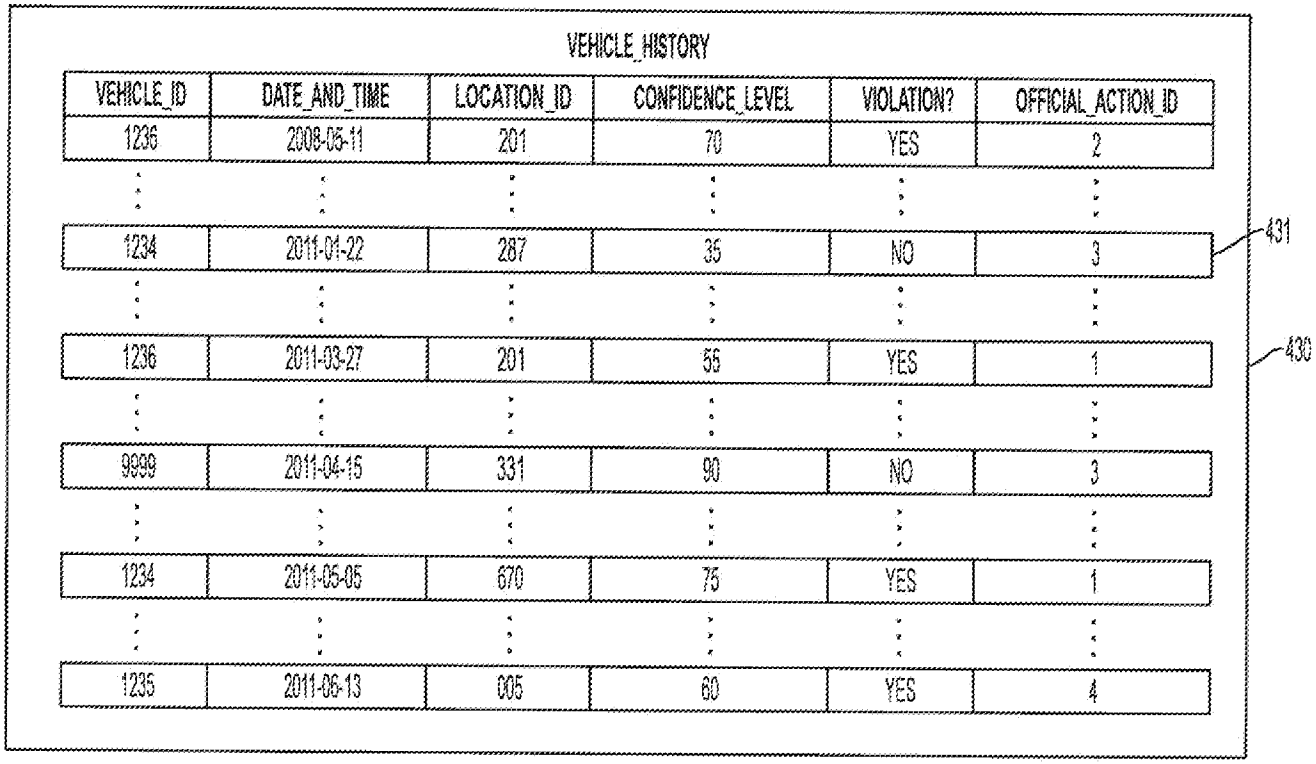
FIG. 4*c* depicts an exemplary instance of a "Vehicle_History" table in the historical database, consistent with certain disclosed embodiments.

FIGS. 4*a*-4*d* depict exemplary instances of database tables 310-340, in which database tables 310-340 are populated with information representing various vehicles and historical information about such vehicles' compliance with HOV rules. For example, as depicted in FIG. 4*a*, Vehicle table 410 may include records containing information about various vehicles, such as each vehicle's license plate number (and associated state), make, model, color, and vehicle type. In some embodiments, each vehicle stored in Vehicle table 410 may be uniquely identified using a "Vehicle_ID" field, which may also be a primary key. In other embodiments, each vehicle stored in Vehicle table 410 may be uniquely identified by a combination of its license plate number and associated state.

"Vehicle" table 410 may be comprehensive in that it may contain a record for all or substantially all registered vehicles, whether or not historical database 250 contains any data representing previous compliance with HOV rules. For example, "Vehicle" table 410 may be populated by vehicle information received from one or more state or federal agencies, such as Departments of Motor Vehicles operated by each state. In another embodiment, "Vehicle" table 410 may include records only for vehicles for which previous HOV compliance has been observed or stored by HOV enforcement system 100. Thus, in such an embodiment, if a vehicle is observed complying with or violating HOV rules, and that vehicle does not have an existing entry in "Vehicle" table 410, HOV enforcement system 100 may dynamically create a new record for that vehicle in "Vehicle" table 410.

As depicted in FIG. 4*b*, "Vehicle_Type" table 420 may comprise data records representing different types of vehicles recognized by HOV enforcement system 100. For example, certain vehicles, such as buses; federal, state, country, or municipal governmental or agency vehicles; taxicabs; motorcycles; medical transporters; or other types of vehicles may be authorized to use HOV lanes at any time, regardless of any kind of passenger configuration rules that might otherwise be imposed on non-authorized vehicles. Those skilled in the art will appreciate that the data records depicted in FIG. 4*b* are exemplary only, and that various other vehicle types may be stored. For example, whereas certain types of vehicle may be permitted to use HOV lanes at any time and under any circumstances, other types of vehicles may be permitted to use HOV lanes only during designated periods of time or only under certain circumstances, such as when a siren or flashing light has been turned on in the vehicle.

As depicted in FIG. 4*c*, a new record may be created in "Vehicle_History" table 430 for each instance in which a vehicle is determined by HOV enforcement system 100 to be violating HOV rules. Thus, as shown in FIG. 4*c*, multiple records may be stored in "Vehicle_History" table 430 for a given unique vehicle that may have only a single record in "Vehicle" table 410. In particular, each time HOV enforcement system 100 detects that a vehicle may be violating one or more HOV rules, HOV enforcement system 100 may store a record in "Vehicle_History" table 430 indicating the non-compliant vehicle by its unique "Vehicle_ID" number, along with an indication of the date and time and the location in which the alleged violation was detected. For example, the "Location_ID" field may link to a separate "Location" database table (not depicted) that divides a jurisdiction (which may be an entire state or country) into distinct segments or areas uniquely identifiable by a "Location_ID" primary key field.

In addition, once an alleged HOV violation has been detected, HOV enforcement system 100 may determine a confidence level representing how certain HOV enforcement system 100 is that a violation has actually been detected. For example, HOV rules in a given enforcement location may dictate that a vehicle need have only two human passengers, one of which may be in a back seat, in order to use an HOV lane. In the event that a vehicle is observed traveling in the HOV lane with only one passenger in the front seat, it may be difficult to determine if the vehicle is violating HOV rules if rear seats in the vehicle are obscured from camera view in any way. Thus, in this example, if two vehicles are identified as potential HOV violators, then records may be created for both vehicles in "Vehicle_History" table 430. However, if HOV enforcement system 100 is able to obtain an unobstructed view into the rear seat area of the cabin for only the first of the two cars, then HOV enforcement system 100 may assign a higher confidence level to its identification of the first car as an HOV violator than to its identification of the second car as an HOV violator.

In the event that a law enforcement official pulls over a candidate HOV violator, additional data may be entered into the record in the "Vehicle_History" table 430 corresponding to the end result of the alleged HOV violation. Such an end result may comprise a manual determination by a law enforcement officer as to whether the vehicle was in fact an HOV violator and what official action the officer took as a result of the manual determination. As depicted in FIG. 4*d*, exemplary official actions may include issuing a ticket to the operator of the identified vehicle (e.g., in the event that the officer determines that the vehicle was correctly identified as an HOV violator); issuing a warning to the operator (e.g., in the event that the officer determines that the vehicle was correctly identified as an HOV violator, but decides to give the operator only a warning); dismissing the operator of the vehicle without issuing a ticket or a warning (e.g., in the event that the officer determines that the vehicle was incorrectly identified as an HOV violator); or excusing the operator of the vehicle without issuing a ticket or a warning (e.g., in the event that the officer determines that the vehicle was correctly identified as an HOV violator, but the operator is determined to have a legitimate excuse, such as a medical emergency).

For example, as depicted in row 431 of "Vehicle_History" table 430, on Jan. 22, 2011, vehicle 1234 was detected by HOV enforcement system 100 in location 287 as potentially violating one or more HOV rules. In response, a law enforcement official pulled over vehicle 1234. However, upon visual inspection, the law enforcement official observed that vehicle 1234 was in fact not violating the HOV rules and, consequently, dismissed the operators of vehicle 1234 without issuing a ticket or a warning. As a result, record 431 includes an indication that vehicle 1234 was not in violation and that the vehicle was dismissed.

In this example, because vehicle 1234 was erroneously identified as an HOV violator and pulled over by law enforcement on Jan. 22, 2011, the present invention provides methods and systems for guarding against erroneously pulling over the same vehicle in the future. In one embodiment, the historical information stored in "Vehicle_History" table 430 may be used to ensure that a future determination by HOV enforcement system 100 that vehicle 1234 is an HOV violator is weighted to some degree against pulling over vehicle 1234 by law enforcement as a result of that determination. Although not limited to any one technique, one approach to guarding against future false positives is to use one or more confidence level thresholds by which candidate violators will not be pulled over by law enforcement if the confidence level associated with HOV enforcement system 100's identification of such candidate violators falls below the confidence level threshold.

For example, as depicted in FIG. 4*e*, "Confidence_Threshold" table 450 may comprise various numeric thresholds for different time periods within the day that must be met in order for HOV enforcement system 100 to initiate or recommend that a given vehicle be pulled over on suspicion of violating HOV rules. Thus, if between the hours of 6:00 AM and 8:00 AM a confidence level threshold of 65 is to be used, only vehicles determined by HOV system 100 to be violating HOV rules by a confidence level of 65 or more may be pulled over by law enforcement.

As depicted in FIG. 4*d*, "Official_Action" table 440 may specify various actions that may be taken by law enforcement in response to HOV enforcement system 100's identification of a vehicle as violating HOV rules. For example, if law enforcement pulls over a vehicle identified as an HOV violator by HOV system 100, and law enforcement determines that the vehicle was violating HOV rules, then law enforcement may ticket the vehicle operator for the violation. And, because the operator of the vehicle has shown a tendency to violate HOV rules in the past, HOV enforcement system 100 may effectively lower the confidence threshold necessary to pull over the same vehicle in the future by adding 20 points to the confidence level of any future determination by HOV enforcement system 100 that the vehicle is violating HOV rules. By effectively weighting future violation detections with respect to that vehicle, HOV enforcement system 100 may therefore reduce the likelihood of future false positives, since it may be assumed that that vehicle is more likely to violate HOV rules in the future than a vehicle with no previous HOV violation history.

Even if law enforcement determines that a vehicle identified by HOV enforcement system 100 as a potential violator is violating HOV rules, law enforcement may nevertheless elect to provide the vehicle operator with only a warning. However, a warning may also have an effect on future violation detections with respect to that vehicle, such as weighting the vehicle in favor of being pulled over to a greater degree than if the operator had been ticketed (e.g., adding a more significant 30 points in the example of FIG. 4*d*) or weighing the vehicle to a lesser degree than if the operator had been ticketed.

In some embodiments, if HOV enforcement system 100 identifies a particular vehicle as an HOV violator and it is determined that the vehicle was not in violation upon being pulled over by law enforcement (a false positive), then HOV enforcement system 100 may attempt to reduce the likelihood of future false positives for that vehicle by decreasing future confidence levels by a certain number of points. In the example of FIG. 4*d*, if a vehicle has been erroneously pulled over by law enforcement, 20 points may be subtracted from the confidence level of future detections by HOV enforcement system 100 that the vehicle is a violator.

Finally, in some cases a vehicle may be determined by law enforcement to be violating HOV rules, yet the operator may be excused. For example, the driver may be operating under emergency circumstances, or law enforcement may excuse the driver on account of an understandable mistake. In such cases, the driver may be excused by law enforcement, and no weighting, either positive or negative, may be given to the vehicle on account of the violation. Those skilled in the art will appreciate that the foregoing types of official action, along with their consequent effects on future confidence levels, are exemplary only. Those skilled in the art will also appreciate that database tables 410-440 are exemplary only, as such data may be stored in multiple database tables spanning multiple databases or separate devices. For example, "Vehicle" table 410 and/or "Vehicle_History" table 430 may not be single tables, but rather their data may be compiled or derived from data stored in separate databases or devices, such as separate data stores maintained by different states or other jurisdictions.

Figure 5:
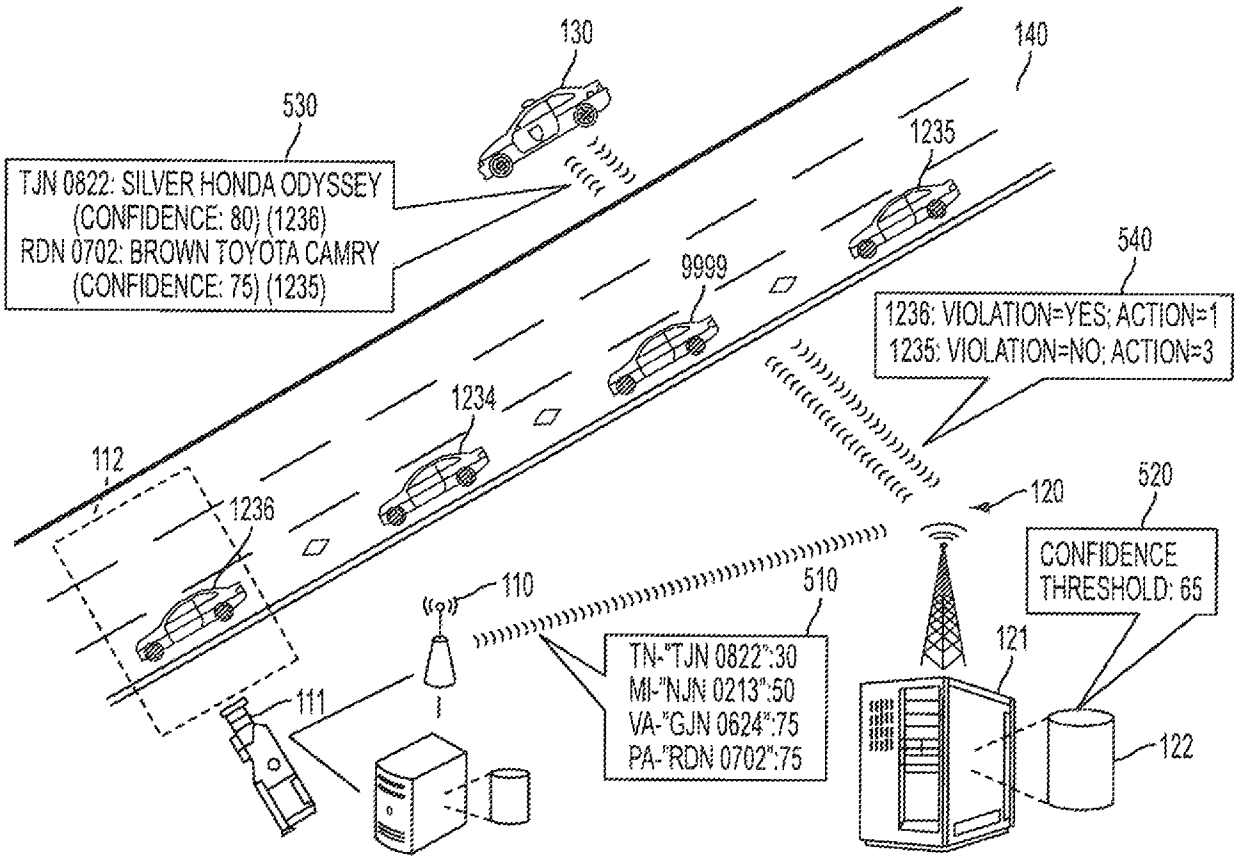
FIG. 5 is a diagram depicting various exemplary applications of using information contained in the historical database to make automated decisions regarding potential violators, consistent with certain disclosed embodiments.

Reference will now be made to FIG. 5, which presents several examples of how HOV enforcement system 100 may respond to detecting potential HOV rule violations by various vehicles by making use of the information stored in historical database 250, including the information stored in database tables 410-440. The operations performed by HOV enforcement system 100 with respect to the examples presented in FIG. 5 are further explained in the flowcharts of FIGS. 6-9.

Figure 6:
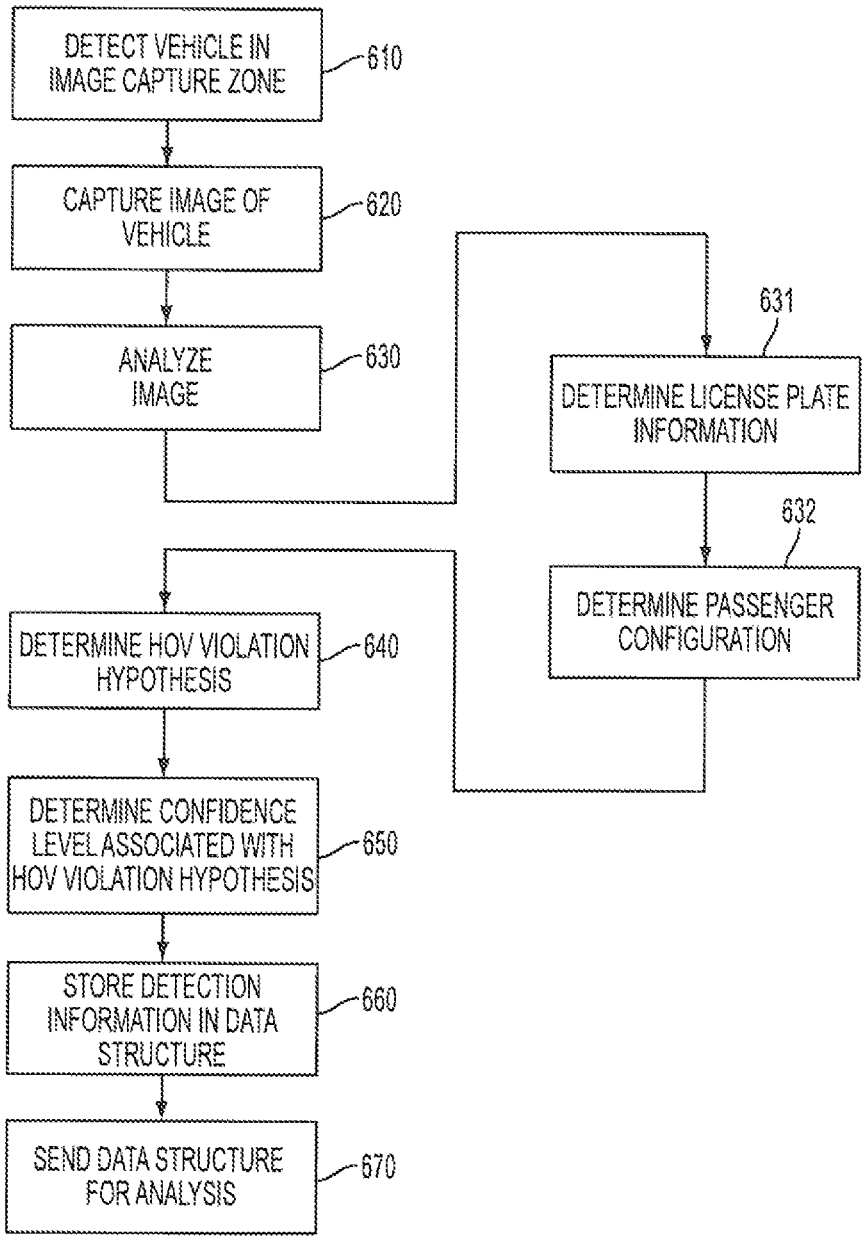
FIG. 6 is a flow diagram illustrating an exemplary method of automatically capturing and analyzing vehicle image data, consistent with certain disclosed embodiments.
Figure 7:
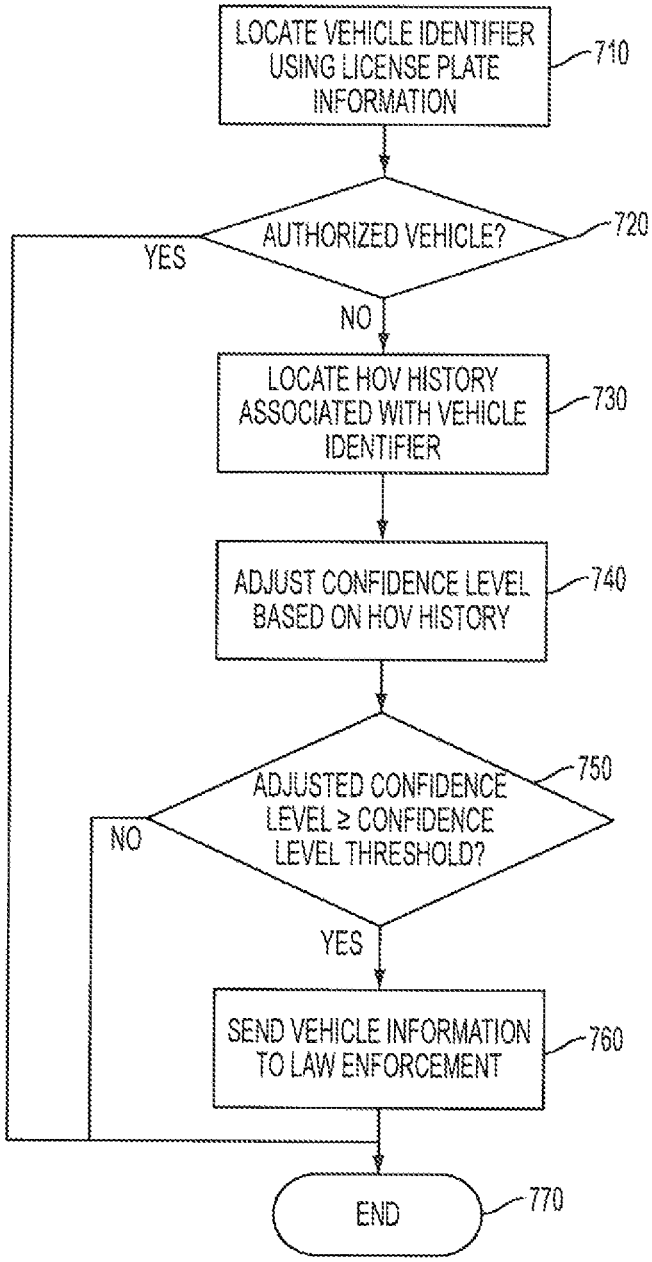
FIG. 7 is a flow diagram illustrating an exemplary method of using historical data to make automated decisions regarding potential violators, consistent with certain disclosed embodiments.
Figure 8:
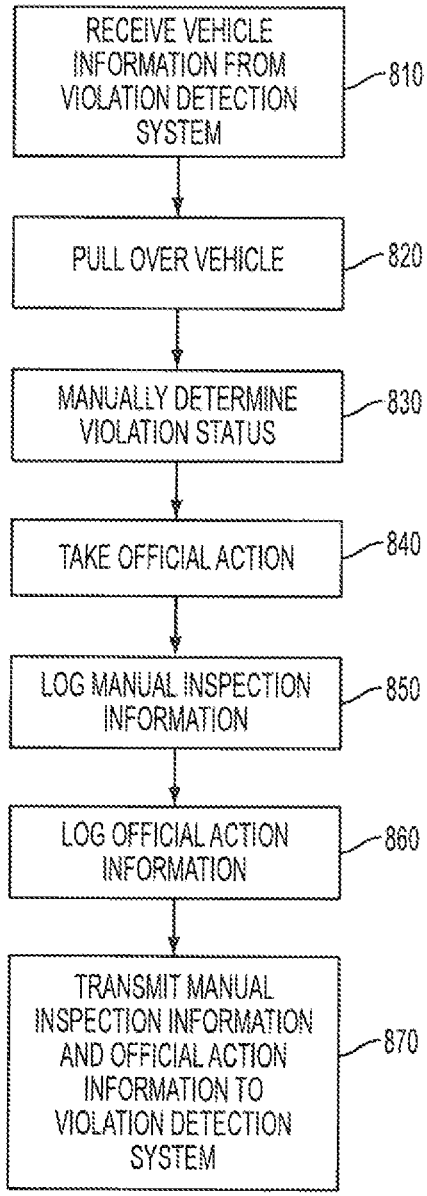
FIG. 8 is a flow diagram illustrating an exemplary method of responding to automated decisions regarding potential violators and supplying information related to manual inspections and official actions taken, consistent with certain disclosed embodiments.
Figure 9:
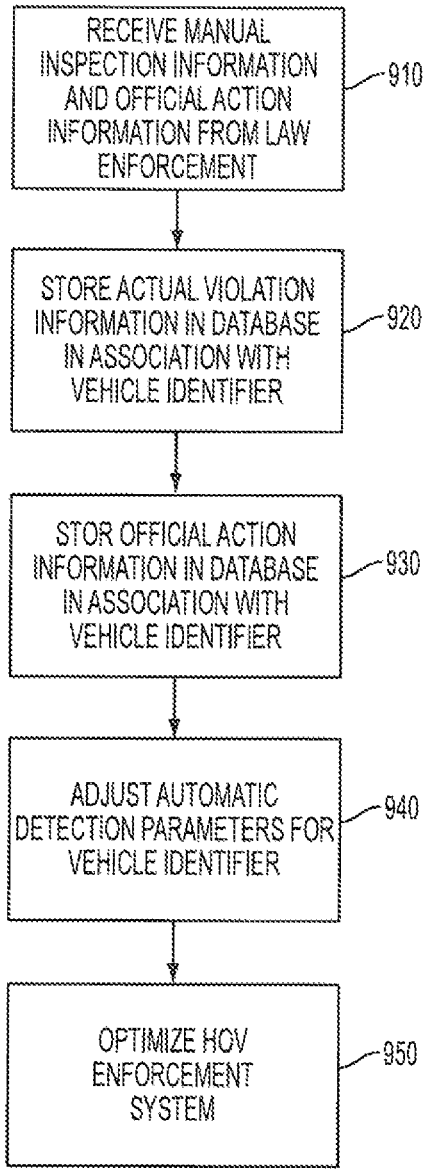
FIG. 9 is a flow diagram illustrating an exemplary method of supplementing historical data and optimizing future violation detection operations, consistent with certain disclosed embodiments.

As depicted in FIG. 5, HOV enforcement system 100 may analyze multiple vehicles 1236, 1234, 9999, and 1235 (corresponding to the vehicle records, identified by the "Vehicle_ID" field, stored in database table 410) in real-time as those vehicles are traveling along HOV lane 140 to determine whether they are violating one or move HOV rules. As depicted in FIG. 6, the process may begin at step 610 when a vehicle is detected in an image capture zone. For example, camera 111 may be coupled to one or more triggering mechanisms or devices (not depicted) that arc configured to detect when a vehicle enters an image capture zone 112. Image capture zone 112 may represent a physical area in which a vehicle must reside in order for camera 111 to capture sufficient image information about the vehicle, such as the vehicle's license plate information and passenger configuration. Exemplary triggering mechanisms may include hoses in HOV lane 140 that are triggered by the compression of vehicle tires running over them, loops buried under the road that are triggered by the weight of vehicles on the road, a laser beam the reflection of which is broken by a passing vehicle, and/or camera 111 itself detecting when a vehicle is within image capture zone 112 through image or light analysis.

In step 620, camera 111 captures an image of the vehicle. For example, as depicted in FIG. 5, vehicle detection system 110 may capture an image of vehicle 1236 once vehicle 1236 travels through image capture zone 112.

In step 630, vehicle detection system 110 may analyze the image of the vehicle to determine, for example, its license plate information (step 631). For example, by analyzing the image of vehicle 1236, vehicle detection system 110 may determine that vehicle 1236 has a Tennessee license plate with the license plate number "TJN 0822." Vehicle detection system 110 may analyze the captured image to determine a vehicle's license plate information using conventional optical character recognition (OCR) techniques that are well known to those of skill in the art.

Vehicle detection system 100 may also analyze the image of the vehicle to determine its passenger configuration (step 632). A vehicle's passenger configuration may comprise any information about the vehicle and/or its passengers that may be relevant to whether a vehicle is violating one or more HOV rules. For example, in the case of an HOV rule that requires that vehicles using HOV lane 140 have two or more passengers, the detected passenger configuration may comprise a simple passenger count based on image analysis. Or, if an HOV rule requires that vehicles using HOV lane 140 have two or more adult passengers, the detected passenger configuration may comprise a determination as to the number of passengers having a certain height, sitting in the front seat, or not sitting in seating designed for minors based on image analysis.

In step 640, vehicle detection system 110 may determine an hypothesis as to whether the vehicle is complying with or violating one or more HOV rules, based on the image analysis. For example, if an HOV rule that is in effect at the time of vehicle 1236's traveling on HOV lane 140 requires that a vehicle have three or more passengers, and vehicle detection system 110's analysis of the image captured by camera 111 indicates that vehicle 1236 has fewer than three passengers, vehicle detection system 110 may formulate an hypothesis that vehicle 1236 is violating HOV rules. In other embodiments, vehicle detection system 110 may make positive hypotheses—e.g., an hypothesis that a vehicle is complying with one or more HOV rules—in addition to or in lieu of negative hypotheses—e.g., an hypothesis that the vehicle is a violator. Those skilled in the art will appreciate that other types of hypotheses are possible.

In step 650, vehicle detection system 110 may determine a confidence level associated with its hypothesis. As described above, vehicle detection system 110 may assign a lower confidence level to an hypothesis that a given vehicle is violating one or more HOV rules if there are factors that would cause its image analysis to be less conclusive, such as an obstructed view of parts of the vehicle's passenger compartment, poor image quality, ambiguity as to whether a given graphical object represents a person or a person of sufficient age, etc. Alternatively, vehicle detection system 110 may assign a higher confidence level where its image analysis is more conclusive. Those skilled in the art will appreciate that different HOV violation hypotheses may be assigned varying confidence levels for a number of different reasons.

For example, in the example of FIG. 5, vehicle detection system 110 may capture images of vehicles 1236, 1234, 9999, and 1235. In the case of vehicle 1236, vehicle detection system 110 may formulate an hypothesis that vehicle 1236 is violating one or more HOV rules, based on image analysis or other operations, but may assign a confidence level of only 30 to that hypothesis. By contrast, vehicle detection system 110 may identify vehicles 1234, 9999, and 1235 as HOV violators, but assign higher confidence levels (50, 75, and 75, respectively) to such hypotheses.

In step 660, vehicle detection system 110 may store this detection information in a data structure. For example, vehicle detection system 110 may create a data structure 510 that includes an entry for each detected potential HOV violation. Data structure 510 may uniquely identify each potential HOV violator by its license plate information, and may include the confidence level it has assigned for each potential violator. Those skilled in the art will appreciate that data structure 510 is exemplary only, and may include other kinds of information or be formatted according to different structures.

In step 670, vehicle detection system 110 may transmit its detection information for analysis. For example, vehicle detection system may wirelessly transmit data structure 510 to violation analysis system 120, which may then analyze the detection information in connection with historical HOV violation information to determine whether law enforcement should be notified of any particular potential HOV violator.

In step 710, violation analysis system 120 may receive the detection information transmitted by vehicle detection system 120 and, for each vehicle included in the detection information, may use the received information about the vehicle (e.g., the license plate information) to determine the unique identifier assigned to the vehicle within HOV enforcement system 100. For example, after receiving data structure 510, violation analysis system 120 may query "Vehicle" table 410 to determine that the vehicle identifier assigned to the Tennessee license plate number "TJN 0822" is 1236. Violation analysis system 120 may do so similarly to identify vehicles 1234, 9999, and 1235 as the detected potential HOV violators based on the information contained in data structure 510.

In step 720, violation analysis system 120 may use the unique vehicle identifier derived in step 710 to determine whether the vehicle identified by vehicle detection system 110 as a potential HOV violator is an authorized vehicle—e.g., a vehicle that need not observe one or more HOV rules. If a given vehicle is determined to be an authorized vehicle (step 720, Yes), then processing may terminate (step 770), and no official action may be taken with respect to the vehicle. For example, violation analysis system 120 may query "Vehicle" table 410 for each of vehicles 1236, 1234, 9999, and 1235 to determine that each vehicle has a "Vehicle_Type_ID" of 2 (corresponding to a "No" value in the "Authorized?" field of "Vehicle_Type" table 420).

If the vehicle is not determined to be an authorized vehicle (step 720, No), then that vehicle's prior HOV history may be analyzed to determine whether it should be pulled over by law enforcement. In step 730, violation analysis system 120 may use the vehicle's identifier to locate any previous HOV history stored in or accessible to violation analysis system 120.

For example, by querying "Vehicle_History" table 430 using vehicle identifier 1236, violation analysis system 120 may determine that vehicle 1236 had been identified as a potential HOV violator on two previous occasions. In particular, vehicle 1236 was identified as a potential HOV violator once on May 11, 2008, and again on Mar. 27, 2011, with confidence levels of 70 and 55, respectively. On both occasions, after vehicle 1236 was pulled over by law enforcement, it was determined that vehicle 1236 was in fact a violator. Vehicle 1236 was given a warning the first time, but was ticketed the second time. Similar details may be determined with respect to vehicles 1234, 9999, and 1235. If a given vehicle has not been previously observed by vehicle detection system 110, information about that vehicle may or may not be present in historical database 250.

In step 740, violation analysis system 120 may adjust the confidence level provided by vehicle detection system 110 as a result of historical information that it locates for the potential HOV violator in historical database 250. For example, in the case of vehicle 1236, because vehicle 1236 had been found to have violated HOV rules on May 11, 2008, and given a warning as a result, 30 points may be added to the confidence level. And because vehicle 1236 had been found to have violated HOV rules again on Mar. 27, 2011, and given a ticket as a result, another 20 points may be added to the confidence level. Thus, even though vehicle detection system 110 indicated a relatively low confidence level of 30 when identifying vehicle 1236 as a potential violator, the previous HOV violation history associated with vehicle 1236 may cause the final adjusted confidence level to be adjusted to a number as high as 80.

Similarly, in the case of vehicle 9999, on Apr. 15, 2011, even though vehicle 9999 was identified by vehicle detection system 110 as a potential violator, "Vehicle_History" table 430 indicates that, when vehicle 9999 was ultimately pulled over by law enforcement, it was found not be in violation of any HOV rules and was dismissed (i.e., a false positive). As a result, violation analysis system 120 may decrease the confidence level of 75 indicated by vehicle detection system 110 by 20 points to reduce the likelihood of future false positives with respect to vehicle 9999. Thus, vehicle 9999's present confidence level may be adjusted downward for a final adjusted confidence level of 55.

In the case of vehicle 1234, although its previous false positive on Jan. 22, 2011 reduces its present HOV violation confidence level by 20 points, its subsequent actual HOV violation on May 5, 2011 increases the confidence level by 20 points, thus creating a net zero effect on its present confidence level to yield a final adjusted confidence level of 50. The same may be said of vehicle 1235, which, although found to be an actual violator on Jun. 13, 2011, was ultimately excused from the violation, which resulted in no future weighing on its confidence levels. Thus, vehicles 1234 and 1235 may be treated no differently than a potential HOV violator with no previous violation history.

In step 750, violation analysis system 120 may compare the vehicle's adjusted confidence level to a confidence level threshold that is to be applied at a given time or in a given location. If the vehicle's adjusted confidence level meets or exceeds the confidence level threshold (step 750, Yes), then information about that vehicle may be sent to law enforcement for the purpose of pulling over that vehicle to determine actual HOV violation status (step 760). If the vehicle's adjusted confidence level does not meet or exceed the confidence level threshold (step 750, No), then processing may terminate, and no official action may be taken with respect to the vehicle.

In the example of FIG. 5, confidence level threshold 520 may be 65. After adjusting confidence levels based on previous violation history, only vehicles 1236 and 1235 (with adjusted confidence levels of 80 and 75, respectively) may be found to meet or exceed confidence level threshold 520. Thus, as a result of each vehicle's previous violation history, a situation is created in which a potential violator that did not meet confidence threshold 520 when originally detected by vehicle detection system 110 (i.e., vehicle 1236) is adjusted to exceed the threshold on account of previous HOV violations, whereas a potential violator that originally exceeded the threshold (i.e., vehicle 9999) is adjusted to fall below the threshold on account of a previous false positive. Accordingly, violation analysis system 120 may transmit information 530 to law enforcement system 130, which describes two vehicles that have been identified as likely HOV violators after historical analysis.

In some embodiments, violation analysis system 120 may accord previous HOV violation information different weight when adjusting a confidence level depending on various factors, such as the chronological and geographical proximity of previous events. For example, although vehicle 1236 was previously found to have violated HOV rules on May 11, 2008, that violation may be weighted less significantly than the HOV violation that occurred on Mar. 27, 2011, when adjusting a present confidence level. For example, violation analysis system 120 may reduce the "Adjustment_Points" of previous HOV violations (or false positives) by 25% for each year that separates a previous event from a current violation hypothesis. Similarly, violation analysis system 120 may weight previous HOV violations of false positives more heavily if they occurred in the same geographic location as a current violation hypothesis, or may reduce the "Adjustment_Points" of previous incidents in proportion to their distance from a current geographic location.

In step 810, law enforcement system 130 may receive the information from violation analysis system 120 that describes which vehicles have been identified as likely HOV violators after historical analysis. As a result, law enforcement may pull over a given vehicle (step 820), at which time law enforcement may determine (e.g., upon manual inspection) whether the vehicle was in fact violating HOV rules, as hypothesized by violation analysis system 120 (step 830). Once the actual violation status has been obtained, law enforcement may take official action (step 840), such as issuing warning, issuing a ticket, or excusing the vehicle (e.g., in the case of an actual violation), or dismissing the vehicle (e.g., in the case of a false positive).

After taking official action, law enforcement may log information related to its manual inspection of the pulled over vehicle and log information indicating what official action it took with respect to the detained vehicle (steps 850 and 860, respectively). Finally, in step 870 the logged manual inspection information and official action information may be transmitted back to violation analysis system 120, where it may be stored by violation analysis system 120 in historical database 250 for the purpose of weighting future decisions with respect to the pulled over vehicle.

For example, after pulling over vehicles 1236 and 1235, law enforcement may determine, upon manual inspection, that vehicle 1236 was violating one or more HOV rules, whereas vehicle 1235 was not. As a result, law enforcement 130 may issue a ticket to vehicle 1236 and may dismiss vehicle 1235. A police officer may then log this information with respect to vehicles 1236 and 1235 into a computing device resident in the officer's vehicle or using a mobile device, such as a smartphone. Such information may be transmitted back to violation analysis system 120, for example in the form of a simple data structure or data stream 540.

In step 910, violation analysis system 120 may receive the manual inspection information and official action information from law enforcement system 130. Violation analysis system 120 may then store the actual violation information and the official action information in historical database 250 (steps 920 and 930, respectively)—for example, by generating a new record in "Vehicle_History" table 430.

In some embodiments, violation analysis system 120 may use the information received from law enforcement 130 to adjust automatic detection parameters for the vehicle once the information is received (step 940). In other embodiments, violation analysis system 120 may wait until the next violation hypothesis is received for that vehicle from vehicle detection system 110 before making any adjustments, in a manner similar to that described above.

In some embodiments, violation analysis system 120 may use the information received from law enforcement 130 to optimize HOV enforcement system 100 by analyzing trends in the data stored in historical database 250 (step 950). For example, if violation analysis system 120 determines that a majority of vehicles that are pulled over having confidence levels between 65 and 70 are ultimately determined to be false positives, violation analysis system may adjust a given confidence threshold of 65 up to 70 to reduce the occurrence of false positives.

Those skilled in the art will appreciate that foregoing embodiments of the invention are exemplary only and that other technological and logistical arrangements may be employed. For example, in the above described embodiments, vehicle detection system 110, which may be local to a particular HOV lane 140, may be used solely to capture and analyze image data for vehicles traveling on HOV lane 140, while historical processing may be performed by a centralized violation analysis system 120 that may not be local to HOV lane 140. Using this approach, multiple vehicle detection systems 110 may be installed at different HOV lanes 140, all of which may send data to a centralized violation analysis system 120. This approach allows local vehicle detection systems 110 to remain relatively lightweight, such that they need processing power and locally stored information only to capture and analyze vehicle images, rather than maintaining a comprehensive historical database 250 at each local vehicle detection system 110. It also enables a centralized violation analysis system 120 to track individual vehicles over multiple locations, such as statewide or nationwide.

However, this configuration is exemplary only. In other embodiments, vehicle detection system 110 may maintain its own historical database 250, which may store information only for vehicles that have been locally detected or may store nationwide vehicle information (e.g., by retrieving or copying data from one or more centralized databases). Vehicle detection system 110 may therefore perform the historical analysis of FIG. 7 locally and may transmit detection information directly to law enforcement system 130. In other embodiments, vehicle detection system 110 may be even more lightweight, and may simply send image data to violation analysis system 120, which may perform both image and historical analysis.

In yet another embodiment, vehicle detection system 110 may not be used. Rather, law enforcement may make initial manual visual hypotheses as to potential HOV violators (e.g., as the cars are traveling on HOV lane 140). Law enforcement may enter information about the violation hypotheses into a local device, such as a computing device or smartphone. That information may then be compared to historical information stored in a local or remote database, which may then be weighted in favor of or against pulling over one or more vehicles based on previous HOV violations, false positives, or other historical information for particular vehicles.

Those skilled in the art will also appreciate that the use of historical information is also not limited to information gained as a result of law enforcement actually pulling vehicles over. For example, if HOV enforcement system 100 has previously detected that a particular vehicle has violated one or more HOV rules, yet the vehicle has not been previously pulled over, HOV enforcement system 100 may adjust future HOV violation hypotheses for that vehicle in favor of pulling it over, albeit perhaps less strongly than if the vehicle had been pulled over and determined to be an actual violator. Similarly, HOV enforcement system 100 may detect that a vehicle has complied with HOV rules in the past, simply through image analysis rather than as the result of the vehicle having been pulled over, and may therefore adjust future HOV violation hypotheses for that vehicle against pulling it over.

In another embodiment, the information sent by violation analysis system 120 to law enforcement system 130 may not be limited to only those vehicles that have been determined to exceed the confidence level threshold after adjustment. Rather, all violation hypotheses may be sent to law enforcement system 130, along with the associated adjusted violation hypotheses, which law enforcement may use to select which vehicles to pull over at its discretion.

The invention is also not limited to HOV lane enforcement, but may be applied to any HOV enforcement or even to enforcement of traffic rules in general. For example, in high-occupancy tolling (HOT), vehicles with certain passenger configurations may be entitled to forgo or pay less at certain toll stops than vehicles with other passenger configurations. In the case of toll systems that allow vehicles to use radio frequency identification (RFID) transponders, vehicle operators may toggle a switch on their RFID transponders to indicate their level of occupancy, which may determine how much the vehicle is charged when driving through an automated tolling station that scans the RFID transponders, including their represented passenger configurations, and charges operators accordingly.

The invention may be applied to HOT enforcement as well. For example, as a vehicle is passing through an automated tolling station, the tolling station may operate in the role of a vehicle detection system 110. Upon receiving the indication from a vehicle's RFID transponder that the vehicle is entitled to a lower toll (e.g., as a result of its passenger configuration), the automated tolling station may capture an image of the vehicle, determine an hypothesis as to whether the represented passenger configuration is accurate, and send such data to a violation analysis system 120. Similar to embodiments described with respect to FIGS. 5-9, the violation analysis system 120 may determine the vehicle's identifier and may use the identifier to locate HOV or HOT violation history associated with the vehicle. Violation analysis system 120 may then use any previous HOV or HOT violation history associated with the vehicle to determine or recommend whether law enforcement should pull the vehicle over—for example, by weighing or adjusting confidence levels associated with the automated tolling station's image analysis.

The foregoing description of the invention, along with its associated embodiments, has been presented for purposes of illustration only. It is not exhaustive and does not limit the invention to the precise form disclosed. Those skilled in the art will appreciate from the foregoing description that modifications and variations are possible in light of the above teachings or may be acquired from practicing the invention. The steps described need not be performed in the same sequence discussed or with the same degree of separation. Likewise, various steps may be omitted, repeated, or combined, as necessary, to achieve the same or similar objectives. Accordingly, the invention is not limited to the above-described embodiments, but instead is defined by the appended claims in light of their full scope of equivalents.

What is claimed is:

1. A computer-implemented method of enforcing traffic rule compliance, comprising:

determining, via a processor, an HOV violation hypothesis, wherein the HOV violation hypothesis comprises a presumption as to whether a vehicle that is detected within a first HOV zone is complying with one or more HOV rules based on a determined observed passenger configuration associated with the vehicle;

retrieving, via the processor and from a data store, one or more data records associated with the vehicle, wherein the one or more data records include historical information identifying past compliance with or violation of HOV rules by the vehicle;

modifying, via the processor, the HOV violation hypothesis based on the historical information, receiving, via the processor, information indicating an actual passenger configuration associated with the vehicle; and storing, via the processor and in the data store, an indication of accuracy associated with the HOV violation hypothesis as a result of comparing the observed passenger configuration to the actual passenger configuration associated with the vehicle.

2. The computer-implemented method of claim 1, wherein the historical information comprises information identifying past compliance with or violation of HOV rules by the vehicle in a second HOV zone that differs from the first HOV zone.

3. The computer-implemented method of claim 2, further comprising:

further modifying, via the processor, the HOV violation hypothesis based on the second HOV zone differing from the first HOV zone.

4. The computer-implemented method of claim 1, wherein:

the historical information comprises information identifying past compliance with HOV rules by the vehicle; and modifying the HOV violation hypothesis comprises decreasing a presumption that the vehicle is violating one or more HOV rules based on the past compliance.

5. The computer-implemented method of claim 4, wherein the historical information further comprises information indicating that the past compliance was determined as a result of the vehicle being detained by law enforcement.

6. The computer-implemented method of claim 1, wherein:

the historical information comprises information identifying past violation of HOV rules by the vehicle; and modifying the HOV violation hypothesis comprises increasing a presumption that the vehicle is violating one or more HOV rules based on the past violation.

7. The computer-implemented method of claim 6, wherein the historical information further comprises information indicating that the past violation was determined as a result of the vehicle being detained by law enforcement.

8. The computer-implemented method of claim 1, further comprising:

modifying a subsequent HOV violation hypothesis with respect to the vehicle based on the historical information and the indication of accuracy.

9. A system configured to enforce traffic rule compliance, comprising:

a processing system comprising one or more processors;

a memory system comprising one or more computer-readable media, wherein the computer-readable media contain program instructions that, when executed by the processing system, cause the processing system to perform operations to:

determine an HOV violation hypothesis, wherein the HOV violation hypothesis comprises a presumption as to whether a vehicle detected within a first HOV zone is complying with one or more HOV rules based on an observed passenger configuration associated with the vehicle;

retrieve, from a data store, one or more data records associated with the vehicle, wherein the one or more data records include historical information identifying past compliance with or violation of HOV rules by the vehicle;

modify the HOV violation hypothesis based on the historical information, receive information indicating an actual passenger configuration associated with the vehicle; and store, in the data store, an indication of accuracy associated with the HOV violation hypothesis as a result of comparing the observed passenger configuration to the actual passenger configuration associated with the vehicle.

10. The system of claim 9, wherein the historical information comprises information identifying past compliance with or violation of HOV rules by the vehicle in a second HOV zone that differs from the first HOV zone.

11. The system of claim 10, wherein the operations further comprise:

further modifying the HOV violation hypothesis based on the second HOV zone differing from the first HOV zone.

12. The system of claim 9, wherein:

the historical information comprises information identifying past compliance with HOV rules by the vehicle; and modifying the HOV violation hypothesis comprises decreasing a presumption that the vehicle is violating one or more HOV rules based on the past compliance.

13. The system of claim 12, wherein the historical information further comprises information indicating that the past compliance was determined as a result of the vehicle being detained by law enforcement.

14. The system of claim 9, wherein:

the historical information comprises information identifying past violation of HOV rules by the vehicle; and modifying the HOV violation hypothesis comprises increasing a presumption that the vehicle is violating one or more HOV rules based on the past violation.

15. The system of claim 14, wherein the historical information further comprises information indicating that the past violation was determined as a result of the vehicle being detained by law enforcement.

16. The system of claim 9, the operations further comprising:

modifying a subsequent HOV violation hypothesis with respect to the vehicle based on the historical information and the indication of accuracy.

17. A computer-implemented method of enforcing traffic rule compliance, comprising:

during a first window of time:

determining, via a processor, a first HOV violation hypothesis, wherein the first HOV violation hypothesis comprises a presumption as to whether a vehicle detected within a first HOV zone is complying with one or more HOV rules based on a determined first observed passenger configuration associated with the vehicle; and storing, via the processor, the first HOV violation hypothesis in a data store; and during a second window of time subsequent to the first window of time:

determining, via the processor, a second HOV violation hypothesis, wherein the second HOV violation hypothesis comprises a presumption as to whether the vehicle detected in the second HOV zone is complying with one or more HOV rules based on a determined second observed passenger configuration associated with the vehicle;

retrieving, via the processor and from the data store, the first HOV violation hypothesis; and modifying, via the processor, the second HOV violation hypothesis based on the first HOV violation hypothesis.

18. The computer-implemented method of claim 17, wherein:

the first HOV violation hypothesis comprises a presumption that the vehicle is violating one or more HOV rules; and modifying the second HOV violation hypothesis comprises increasing a presumption that the vehicle is violating one or more HOV rules during the second window of time.

19. The computer-implemented method of claim 17, wherein:

the first HOV violation hypothesis comprises a presumption that the vehicle is not violating one or more HOV rules; and modifying the second HOV violation hypothesis comprises decreasing a presumption that the vehicle is violating one or more HOV rules during the second window of time.

20. A system configured to enforce traffic rule compliance, comprising:

a processing system comprising one or more processors;

a memory system comprising one or more computer-readable media, wherein the computer-readable media contain program instructions that, when executed by the processing system, cause the processing system to perform operations comprising:

during a first window of time:

detecting a vehicle within a first HOV zone;

determining a first observed passenger configuration associated with the vehicle;

determining a first HOV violation hypothesis, wherein the first HOV violation hypothesis comprises a presumption as to whether the vehicle is complying with one or more HOV rules based on the first observed passenger configuration; and storing the first HOV violation hypothesis in a database; and during a second window of time subsequent to the first window of time:

detecting the vehicle within a second HOV zone;

determining a second observed passenger configuration associated with the vehicle;

determining a second HOV violation hypothesis, wherein the second HOV violation hypothesis comprises a presumption as to whether the vehicle is complying with one or more HOV rules based on the second observed passenger configuration;

retrieving, from the database, the first HOV violation hypothesis; and modifying the second HOV violation hypothesis based on the first HOV violation hypothesis.

21. The system of claim 20, wherein:

the first HOV violation hypothesis comprises a presumption that the vehicle is violating one or more HOV rules; and modifying the second HOV violation hypothesis comprises increasing a presumption that the vehicle is violating one or more HOV rules during the second window of time.

22. The system of claim 20, wherein:

the first HOV violation hypothesis comprises a presumption that the vehicle is not violating one or more HOV rules; and modifying the second HOV violation hypothesis comprises decreasing a presumption that the vehicle is violating one or more HOV rules during the second window of time.

* * * * *